US007159400B2

(12) United States Patent
Tsutsui et al.

(10) Patent No.: US 7,159,400 B2
(45) Date of Patent: Jan. 9, 2007

(54) RANKINE CYCLE APPARATUS

(75) Inventors: Toshihiro Tsutsui, Wako (JP); Syogo Kawajiri, Wako (JP); Makoto Uda, Wako (JP); Hiroyoshi Taniguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 111 days.

(21) Appl. No.: 10/953,343

(22) Filed: Sep. 30, 2004

(65) Prior Publication Data

US 2005/0072156 A1 Apr. 7, 2005

(30) Foreign Application Priority Data

Oct. 2, 2003 (JP) ..... 2003-344492
Nov. 14, 2003 (JP) ..... 2003-385779

(51) Int. Cl.
*F22D 1/00* (2006.01)

(52) U.S. Cl. ..... 60/665; 60/667

(58) Field of Classification Search ..... 60/660, 60/670, 666, 667, 665
See application file for complete search history.

(56) References Cited

U.S. PATENT DOCUMENTS 3,125,073 A * 3/1964 Profos ..... 122/379
3,906,731 A * 9/1975 Carlson ..... 60/665
4,020,637 A 5/1977 Izumi

FOREIGN PATENT DOCUMENTS

| | | | |
|---|---|---|---|
| DE | 195 24 171 | A1 | 1/1997 |
| JP | 49-92439 | A | 9/1974 |
| JP | 58-124603 | A | 8/1983 |
| JP | 2002-115504 | A | 4/2002 |

* cited by examiner

*Primary Examiner*—Hoang Nguyen
(74) *Attorney, Agent, or Firm*—Birch,Stewart,Kolasch and Birch, LLP

(57) ABSTRACT

When a flow of a working medium stagnates in an expander or evaporator of a Rankine cycle apparatus including a closed working medium circulation circuit, a high pressure exceeding an allowable maximum pressure level of the expander or evaporator is produced within the closed working medium circulation circuit. In such a case, the water-phase working medium is first discharged via relief valves out of the circulation circuit, so that the pressure within the circulation circuit can be lowered. Then, once vapor within the evaporator, having been lowered in temperature and pressure, flows backward within the closed working medium circulation circuit, the vapor is also discharged via the relief valves out of the circulation circuit. In this way, the pressure within the expander or evaporator can be reliably prevented from exceeding the allowable maximum pressure level.

13 Claims, 12 Drawing Sheets

FIG.16A
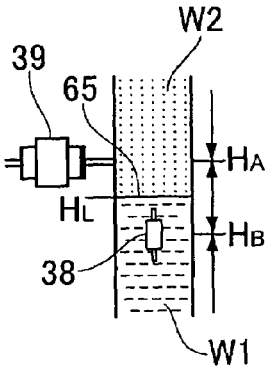
FIG.16B
| LIQUID LEVEL POSITION | AIR VENT | RETURN PUMP |
|---|---|---|
| HIGHER THAN HA | OPENED | OFF |
| BETWEEN HA & HB | CLOSED | OFF |
| LOWER THAN HB | CLOSED | ON |
FIG.17
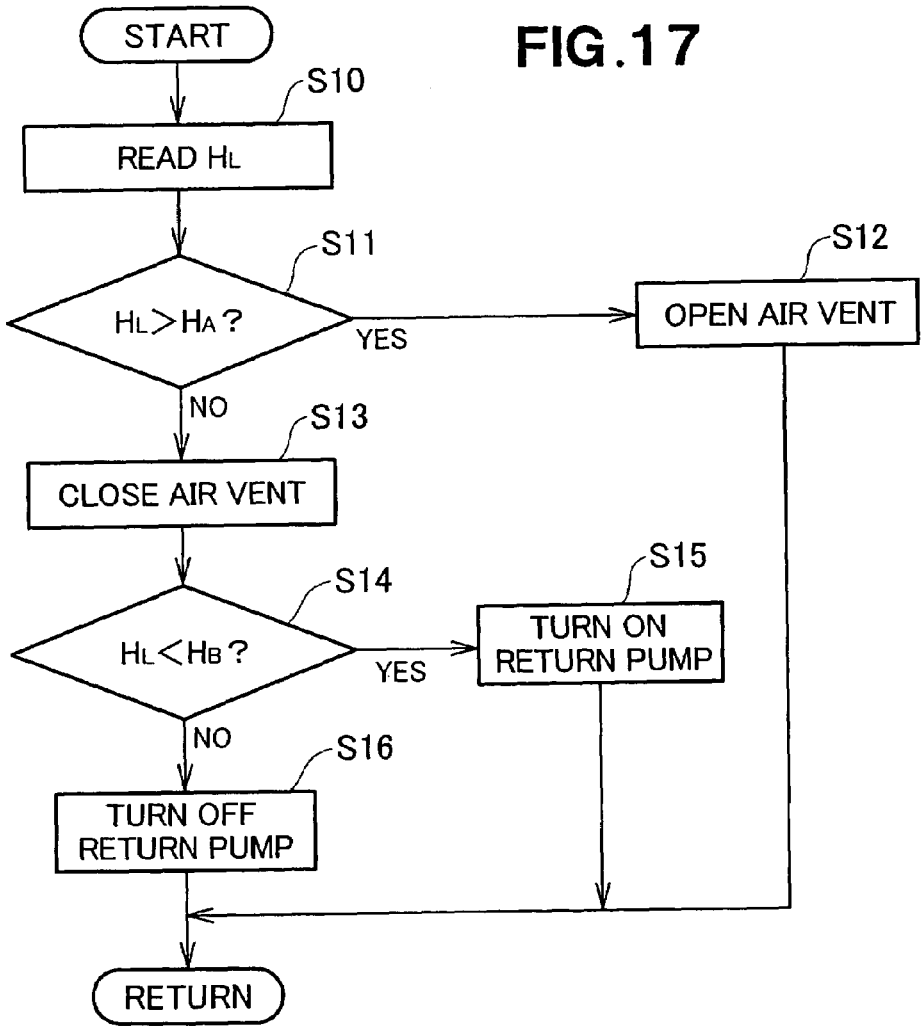

RANKINE CYCLE APPARATUS

This Nonprovisional application claims priority under 35 U.S.C. 119(a) on patent application No(s). 2003-344492 and 2003-385779 filed in Japan on Oct. 2, 2003 and Nov. 14, 2003, respectively, the entire contents of which are hereby incorporated by reference.

FIELD OF THE INVENTION

The present invention relates generally to Rankine cycle apparatus, and more particularly to a Rankine cycle apparatus which is used, for example, as a vehicle-mounted apparatus for converting exhaust heat energy of a vehicle-mounted engine into mechanical energy.

BACKGROUND OF THE INVENTION

Rankine cycle apparatus have been known as systems for converting heat energy into mechanical work. The Rankine cycle apparatus include a structure for circulating water as a working medium, in the liquid and gaseous phases within a sealed piping system forming a circulation system in the apparatus. Generally, the Rankine cycle apparatus include a water supplying pump unit, an evaporator, an expander, a condenser, and pipes connecting between these components to provide circulation circuitry.

FIG. 19 hereof is a schematic block diagram of a general setup of a conventionally-known Rankine cycle apparatus (e.g., vehicle-mounted Rankine cycle apparatus) and certain details of a condenser employed in the Rankine cycle apparatus. The Rankine cycle apparatus of FIG. 19 includes a water supplying pump unit 110, an evaporator 111, an expander 107, and the condenser 100. These components 110, 111, 107 and 100 are connected via pipes 108 and 115, to provide circulation circuitry in the apparatus.

Water (liquid-phase working medium), which is supplied, a predetermined amount per minute, by the water supplying pump unit 110 via the pipe 115, is imparted with heat by the evaporator 111 to turn into water vapor (gaseous-phase working medium). The vapor is delivered through the next pipe 115 to the expander 107 that expands the water vapor. Mechanical device (not shown) is driven through the vapor expansion by the expander 107 so as to perform desired mechanical work.

Then, the expanded water vapor is delivered through the pipe 108 to the condenser 100, where the vapor is converted from the vapor phase back to the water phase. After that, the water is returned through the pipe 115 to the water supplying pump unit 110, from which the water is supplied again for repetition of the above actions. The evaporator 111 is constructed to receive heat from an exhaust pipe extending from the exhaust port of the engine of the vehicle. Among various literatures and documents showing structural examples of the Rankine cycle apparatus is Japanese Patent Laid-Open Publication No. 2002-115504.

The following paragraphs detail a structure and behavior of the condenser 100 in the conventional vehicle-mounted Rankine cycle apparatus, with reference to FIG. 19.

The condenser 100 includes a vapor introducing chamber 101, a water collecting chamber 102, and a multiplicity of cooling pipes 103 vertically interconnecting the two chambers 101 and 102. In the figure, only one of the cooling pipes 103 is shown in an exaggerative manner. Substantial upper half of the interior of each of the cooling pipes 103 is a vapor (gaseous-phase) portion 104, while a substantial lower half of the interior of the cooling pipe 103 is a water (liquid-phase) portion 105. In the vapor portion 104, most of the working medium introduced via the vapor introducing chamber 101 to the cooling pipe 103 is in the gaseous phase, while, in the water portion 105, most of the working medium flowing through the cooling pipe 103 is kept in the liquid (condensed water) phase. Boundary between the vapor 104 and the water 105 (i.e., gas-liquid interface) is a liquid level position 112.

One cooling fan 106 is disposed behind the cooling pipes 103 (to the right of the cooling pipes 103 in FIG. 19). The cooling fan 106 is surrounded by a cylindrical shroud 106*a*. Normally, operation of the cooling fan 106 is controlled by an electronic control unit on the basis of a water temperature at an outlet port of the condenser 100. The single cooling fan 106 sends air to the entire region, from top to bottom, of all of the cooling pipes 103 to simultaneously cool the cooling pipes 103.

The condenser 100 operates as follows during operation of the Rankine cycle apparatus. Water vapor of a relatively low temperature, discharged from the expander 107 with a reduced temperature and pressure, is sent into the vapor introducing chamber 101 of the condenser 100 via the low-pressure vapor pipe 108 and then directed into the cooling pipes 103. Cooling air 109 drawn into the cooling fan 106 is sent to the condenser 100.

Strong cooling air is applied by the cooling fan 106 to the upstream vapor portion 104 of the condenser 100, i.e. a portion of each of the cooling pipes 103 where a mixture of the vapor and water exists, and thus latent heat emitted when the vapor liquefies can be recovered effectively by the cooling air. Cooling air is also applied by the cooling fan 106 to the downstream water portion 105 of the condenser 100, i.e. a portion of each of the cooling pipes 103 where substantially only the water exists. Water condensed within the cooling pipes 103 of the condenser 100, is collected into the water collecting chamber 102 and then supplied by the water supplying pump unit 110 to the evaporator 111 in a pressurized condition as noted above.

In FIG. 19, reference numeral 116 represents a surface area of a condensing heat transmission portion, and 117 represents a surface area of a heat transmission portion of the condensed water. The surface areas 116 and 117 of the heat transmission portions and the liquid level position 112 have the following relationship.

The conventional Rankine cycle apparatus 100 inherently has the characteristic that the liquid fluid position 112 varies. Namely, because the engine output varies in response to traveling start/stop and transient traveling velocity variation of the vehicle, the amount of water supply to the evaporator 111 also varies, in response to which the liquid level position 112 within the condenser 100 varies. Namely, in the condenser 100, the liquid level position 112 rises when the amount of the vapor flowing into the condenser 100 (i.e., inflow amount of the vapor) is greater than the amount of the condensed water discharged from the condenser 100 (i.e., discharge amount of the condensed water), but lowers when the inflow amount of the vapor is smaller than the discharge amount of the condensed water. In this way, the vapor-occupied portion (104) in the cooling pipes 103 of the condenser 100 increases or decreases. Because the condensed water (in the portion 105) is discharged from the water supplying pump unit 110 subjected to predetermined flow rate control, a pressure from an outlet port 113 of the expander 107 to an inlet port 114 of the water supplying pump unit 110 is determined by a pressure within the condenser 100. The pressure within the condenser 100 is determined by an amount of condensing heat exchange caused by cooling of the vapor portion of the condenser, and the amount of condensing heat exchange is determined by a flow rate of the medium to be cooled and a surface area of the condensing heat transmission portion 116. Thus, if the portion occupied with the vapor increases or decreases due to variation (rise or fall) of the liquid level position 112, the surface area 116 of the condensing heat transmission portion increases or decreases and so the pressure within the condenser 100 and the flow rate of the medium to be cooled do not uniformly correspond to each other any longer.

Similarly, the temperature of the condensed water at the outlet port of the condenser 100 is determined by an amount of heat exchange caused by cooling of the water portion (105) of the condenser, and the amount of the heat exchange of the condensed water is determined by the flow rate of the medium to be cooled and a surface area 117 of a heat transmission portion of the condensed water. Thus, if the portion occupied with the condensed water (105) increases or decreases due to variation (rise or fall) of the liquid level position 112, the surface area 117 of the heat transmission of the condensed water portion increases or decreases and so the temperature of the condensed water and the flow rate of the medium to be cooled do not uniformly correspond to each other any longer. When the high-temperature vapor has reached an unusually high pressure due to some system anomaly in the above-described Rankine cycle apparatus, there arises a need to promptly restore the vapor from the unusually high pressure to a normal pressure without hindering the functions of relevant components.

For that purpose, a chlorofluorocarbon-turbine composite engine disclosed in Japanese Patent Laid-Open Publication No. SHO-49-92439 includes a pressure relief valve provided in a branch vapor pipe. Namely, in this composite engine, the outlet of an evaporator and the inlet of a condenser are connected by the branch vapor pipe via the relief valve, so that vapor can be bypassed when the interior pressure of the evaporator is at high level. However, with this composite engine, which is constructed to only adjust the pressure via the pressure relief valve provided in the branch vapor pipe, it is difficult to appropriately control a high-pressure vapor in and near the evaporator.

Further, Japanese Utility Model Laid-Open Publication No. SHO-58-124603 discloses a Rankine cycle apparatus which includes control valves between a condenser and a liquid tank and near the outlet of an evaporator. The control valves function to close circulation circuitry while the apparatus is in an OFF state or in a non-operating state, so as to prevent a liquid-phase working medium from filling an expander and condenser. With these control valves, however, the disclosed Rankine cycle apparatus can not quickly respond to a pressure increase between a water supplying pump and the evaporator.

Generally, when a high pressure, exceeding an allowable maximum pressure level of the expander or evaporator, has been produced within the circulation circuitry of the Rankine cycle apparatus, for example, due to a stagnated flow of the working medium, there arises a need to discharge the high-temperature and high-pressure working medium out of the circulation circuitry in order to promptly lower the pressure so that the expander, evaporator, etc. can be properly protected and can readily resume their operations. In such a case, it is necessary to lower the temperature and pressure of the working medium itself and minimize adverse influences exerted by the working medium on peripheral devices, such as an exhaust device of a vehicle engine.

Further, it is necessary to lower the pressure in quick response to a high-pressure vapor in and near the evaporator and a rapid pressure increase, beyond the allowable maximum pressure level, of water between the pump and the evaporator.

SUMMARY OF THE INVENTION

The present invention provides an improved Rankine cycle apparatus constructed into a closed circulation circuit, which comprises: an evaporator for heating and thereby converting a liquid-phase working medium into a gaseous-phase working medium, using heat from a heat source; an expander for converting heat energy of the gaseous-phase working medium, discharged by the evaporator, into mechanical energy; a condenser for cooling and thereby converting the gaseous-phase working medium, discharged by the expander, to the liquid phase; a supply pump for supplying, in a pressurized condition, the liquid-phase working medium, discharged by the condenser, to the evaporator, and a discharge valve device provided between the supply pump and the evaporator in a portion of the closed circulation circuit where the working medium is present in a liquid-phase state. When the interior pressure of the closed circulation circuit is higher than a predetermined limit pressure level that is lower than at least an allowable maximum pressure level of the expander or the evaporator, the discharge valve device discharges the working medium out of the closed circulation circuit.

When the flow of the working medium stagnates in the expander or evaporator, a high pressure, exceeding the allowable maximum pressure level of the expander or evaporator, is produced within the closed circulation circuit. In such a case, the water-phase working medium is first discharged via a relief valve of the valve device out of the circulation circuit. Then, the gaseous-phase working medium (saturated vapor), having been lowered in temperature and pressure is also discharged via the relief valve out of the circulation circuit. In this way, the pressure within the expander or evaporator in the closed circulation circuit can be reliably prevented from exceeding the allowable maximum pressure level; thus, the evaporator and expander can be reliably protected from excessive pressure, and the operations of the components can be readily resumed. Further, because the working medium itself is lowered in temperature and pressure as the high-pressure and high-temperature working medium is discharged out of the closed circulation circuit, the present invention can minimize adverse influences exerted by the working medium on peripheral devices, such as an exhaust device of an engine. Furthermore, the present invention can lower the pressure in quick response to a high-pressure vapor in and near the evaporator and a rapid pressure increase, beyond the allowable maximum pressure level, of water present in a pipe between the supply pump and the evaporator.

Preferably, in the present invention, at least a portion of the working medium to be discharged out of the closed circulation circuit via the discharge valve device is discharged around the heat source. Therefore, the heat source of the evaporator and the evaporator itself can be cooled with the discharged working medium; particularly, appropriate pressure reduction can be achieved by lowering the temperature of the gaseous-phase working medium. Further, the present invention can minimize adverse influences on the peripheral devices and can prevent excessive heating due to excessive temperature increase of the heat source (e.g., exhaust passageway of the engine) and evaporator.

Preferably, in the present invention, the discharge valve device includes a plurality of discharge passageways for directing the working medium out of the closed circulation circuit, and a flow rate limiter, such as an orifice, is provided in at least one of the plurality of discharge passageways. With the flow rate limiter capable of adjusting the discharge flow rate of the working medium, it is possible to adjust the adverse influences on the peripheral devices. Particularly, the present invention can achieve an optimal discharge flow rate to appropriately prevent rapid cooling of, and hence thermal impact on, the high-temperature heat source (e.g., exhaust passage-way of the engine) and other components peripheral to the heat source and the evaporator. In this way, the present invention permits appropriate cooling of the components.

Further, the discharge valve device is preferably disposed at least closer to the pump unit than the evaporator. Thus, the discharge valve device is located remote from the evaporator, so that the amount of the liquid-phase working medium discharged, via the discharge valve device, out of the closed circulation circuit can be increased accordingly. Also, the discharge of the liquid-phase working medium can lower the temperature and pressure within the circulation circuit, which can reduce the pressure of the gaseous-phase working medium to be subsequently discharged out of the closed circulation circuit and thereby lower the discharge pressure (flow rate) of the gaseous-phase working medium. As a result, adverse influences on the peripheral devices can be minimized.

BRIEF DESCRIPTION OF THE DRAWINGS

Certain preferred embodiments of the present invention will hereinafter be described in detail, by way of example only, with reference to the accompanying drawings, in which:

FIGS. 16A and 16B are a view and table explanatory of details of liquid level position settings;

FIG. 17 is a flow chart showing an operational sequence of liquid level position control;

DETAILED DESCRIPTION OF THE PREFERRED EMBODIMENTS

Figure 1:
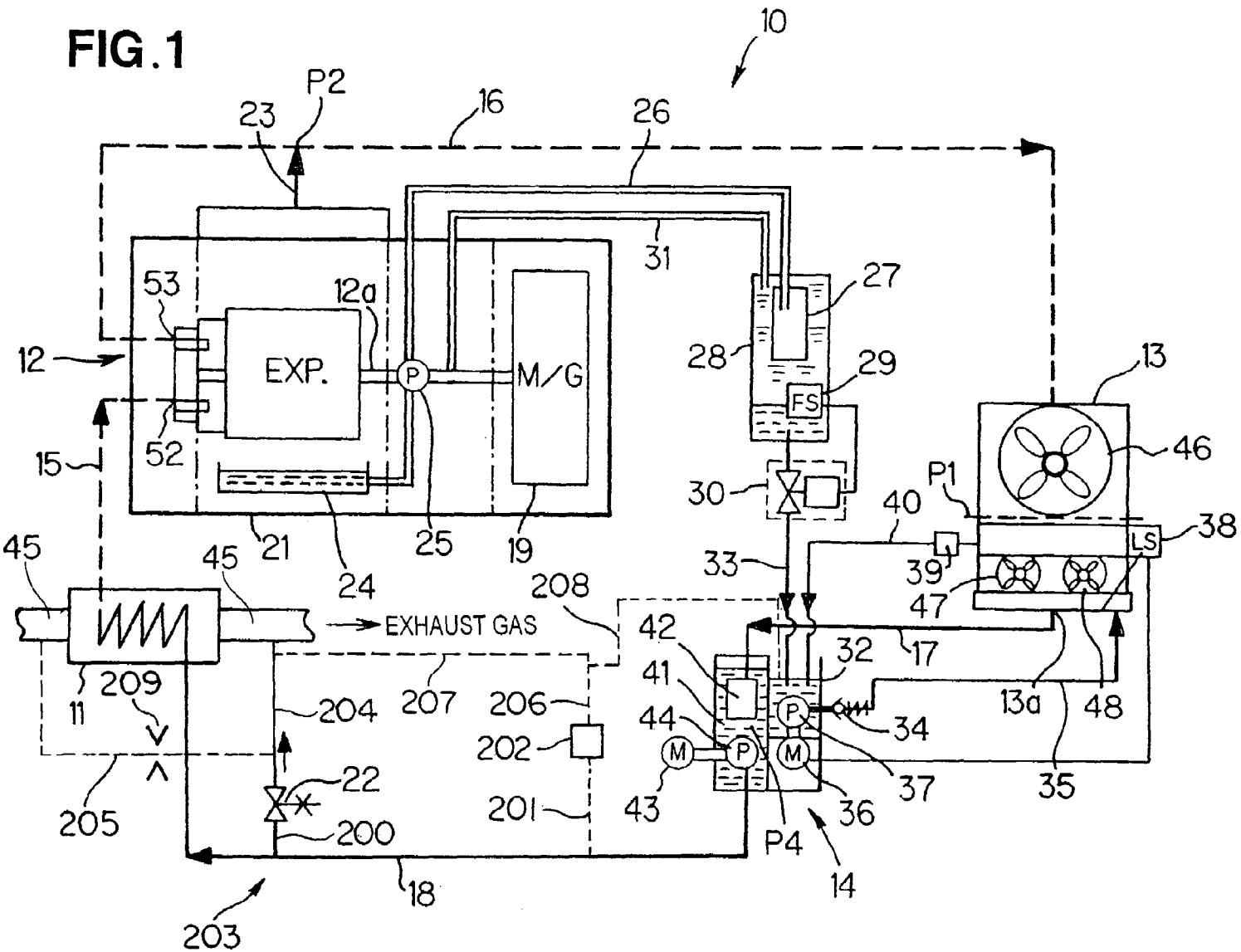
FIG. 1 is a block diagram showing a general system setup of a Rankine cycle apparatus in accordance with an embodiment of the present invention.

First, a description will be made about an example general setup of a Rankine cycle apparatus in accordance with an embodiment of the present invention, with reference to FIG. 1.

The Rankine cycle apparatus 10 includes an evaporator 11, an expander 12, a condenser 13, and a water supplying pump unit 14 provided with a supply pump.

The evaporator 11 and the expander 12 are interconnected via a pipe 15, and the expander 12 and the condenser 13 are interconnected via a pipe 16. Further, the condenser 13 and the water supplying pump unit 14 are interconnected via a pipe 17, and the water supplying pump unit 14 and the evaporator 11 are interconnected via a pipe 18. With such a piping structure, there is formed closed circulation circuitry (circulation system) through which a working medium is circulated within the Rankine cycle apparatus 10 in the gaseous or liquid phase. The working medium in the Rankine cycle apparatus 10 is in water (liquid) and water vapor (gaseous) phases.

The circulation circuitry of the Rankine cycle apparatus 10 has a circulating structure hermetically sealed from the outside, which allows water or vapor to circulate therethrough.

In the circulation circuitry of the Rankine cycle apparatus 10, the water (liquid-phase working medium) travels from a liquid level position, indicated by a broken line P1, within the condenser 13, through the water supplying pump unit 14, to the evaporator 11. In FIG. 1, the pipes 17 and 18, through which the water travels, are indicated by thick solid lines. The vapor (gaseous-phase working medium) travels from the evaporator 11, through the expander 12, to the liquid level position P1 within the condenser 13. The pipes 15 and 16, through which the vapor travels, are indicated by thick broken lines.

The pipe 18, extending in a low temperature region between the water supplying pump unit 14 and the evaporator 11, has two branch pipes 200 and 201. First and second relief valves 22 and 202 are provided in the branch pipes 200 and 201, respectively.

Discharge (relief) valve device 203 is provided, in a portion of the circulation circuitry, for discharging the liquid-phase working medium out of the circulation circuitry when the circuitry has an interior pressure higher than a predetermined upper limit pressure. At least a portion of the working medium discharged out of the closed circuitry via the discharge valve device 203 is discharged around an exhaust pipe 45 that functions as a heat source of the Rankine cycle apparatus 10.

The discharge valve device 203 includes a plurality of discharge passageways (discharge pipes) 204, 205, 206, 207 and 208 for discharging the working medium out of the closed circuitry. Flow rate limiter (such as an orifice) 209 is provided in at least one of the discharge passageways. The discharge valve device 203 is disposed closer to the water supplying pump unit 14 than the evaporator 11.

Note that, although the embodiment of FIG. 1 is shown as including two, i.e. first and second, relief valves 22 and 202, it may include only one such relief valve.

The Rankine cycle apparatus 10 is constructed to phase-convert water into water vapor using heat from the heat source, and produce mechanical work using expansion of the water vapor. The evaporator 11 is a mechanism for converting water into vapor.

As will be later described in detail, the Rankine cycle apparatus 10 is constructed as a vehicle-mounted apparatus suitable for mounting on an automotive vehicle. For that purpose, the evaporator 11 uses heat of exhaust gas from the vehicle engine as the heat source. Namely, the evaporator 11 uses heat of the exhaust gas, flowing through an exhaust pipe 45 of the engine (internal combustion engine), to heat and superheat water supplied from the water supplying pump unit 14, so as to produce high-temperature and high-pressure water vapor. The high-temperature and high-pressure water vapor produced by the evaporator 11 is supplied to the expander 12.

Needless to say, the evaporator 11 may use higher-temperature exhaust gas from an exhaust port, exhaust manifold (not shown) or the like located downstream of an exhaust valve of the engine, rather than from the exhaust pipe 45.

The expander 12 has an output shaft 12*a* connected to the rotor (not shown) or the like of a motor/generator (M/G) 19 so as to allow the motor/generator (M/G) 19 to operate as a generator. The expander 12 is constructed to expand the high-temperature and high-pressure water vapor supplied from the evaporator 11 and rotates the output shaft 12*a* through the expansion of the vapor. The rotation of the output shaft 12*a* rotates the rotor of the motor/generator 19 to cause the motor/generator 19 to make predetermined mechanical rotation or perform predetermined power generation operation. The output shaft 12*a* of the expander 12 is also connected to a hydraulic pump 25 to drive the pump 25.

As noted above, the expander 12 produces mechanical work through the expansion of the high-temperature and high-pressure water vapor supplied from the evaporator 11 via the pipe 15 and thereby drives various loads, such as the motor/generator 19 and hydraulic pump 25. The vapor 12 discharged from the evaporator 12 decreases in temperature and pressure and is delivered via the pipe 16 to the condenser 13 with the decreased temperature and pressure.

The condenser 13 cools and liquefies the vapor delivered from the evaporator 12. Water produced through the liquefaction by the condenser 13 (i.e., condensed water) is returned via the pipe 17 to the water supplying pump unit 14.

High-pressure pump 44 of the water supplying pump unit 14 pressurizes the water liquefied by the condenser 13 i.e., condensed water from the condenser 13) and re-supplies or replenishes the pressurized condensed water to the evaporator 11.

The Rankine cycle apparatus 10 having the above-described general system setup includes the following as other relevant components.

Within a casing 21 of the expander 12, there is provided a breather (separator) 23 for returning leaked water vapor to the pipe 16. Further, within the casing 21, an oil pan 24 is disposed under the expander 12. Oil built up in the oil pan 24 with water mixed therein is delivered by the hydraulic pump 25 to an oil coalescer 27 via a pipe 26.

The oil and water are separated from each other by the oil coalescer 27, and the separated water is stored in a lower portion of an oil tank 28 due to a difference in specific gravity. Valve mechanism 30 operating on the basis of a float sensor 29 is mounted in the oil tank 28.

The oil separated from the water by the oil coalescer 27 and stored in an upper portion of the oil tank 28 is supplied, through a pipe 31, to various sections of the expander 12 by way of an oil path (not shown) formed in the output shaft 12*a*.

The water stored or accumulated in the lower portion of the oil tank 28 is supplied, via a pipe 33, to an open tank 32 of the water supplying pump unit 14 through operation of the valve mechanism 30. The open tank 32 is so named because it is open to the atmospheric air, and it accumulates or stores therein the working medium, leaked or discharged out of the circulation circuitry, in the liquid-phase state.

The open tank 32 of the water supplying pump unit 14 and the condenser 13 are interconnected by a pipe 35 via a water supplying return pump 37 and check valve 34.

The condenser 13 includes a liquid level sensor 38 and air vent 39 provided near the liquid level position. Water supply from the open tank 32 to the condenser 13 is performed by the water supplying return pump 37 that is driven by a motor 36 turned on/off in response to a signal from the liquid level sensor 38. Further, the open tank 32 and the condenser 13 are interconnected by a pipe 40 that discharges the water via the air vent 39.

The pipe 17 for returning the condensed water discharged from the condenser 13 is connected to a water coalescer 42 within a sealed tank 41 of the pump unit 14. Water in the sealed tank 41 is supplied, by the high-pressure water supplying pump 44 driven by a motor 43, to the evaporator 11 via the pipe 18.

Further, in association with the condenser 13, there are provided a plurality of cooling fans 46–48 for generating cooling air independently for different portions of the condenser 13.

In the above-described arrangements, a working medium supply device is constituted by elements pertaining to the liquid level position within the condenser 13 and lower section of the condenser 13 and by the water supplying pump unit 14.

In the closed working medium circulation system of the Rankine cycle apparatus 10, a working medium leaked from the breather 23 of the expander 12 is returned via an outlet port P2 to the pipe 16 of the circulation system.

Figure 2:
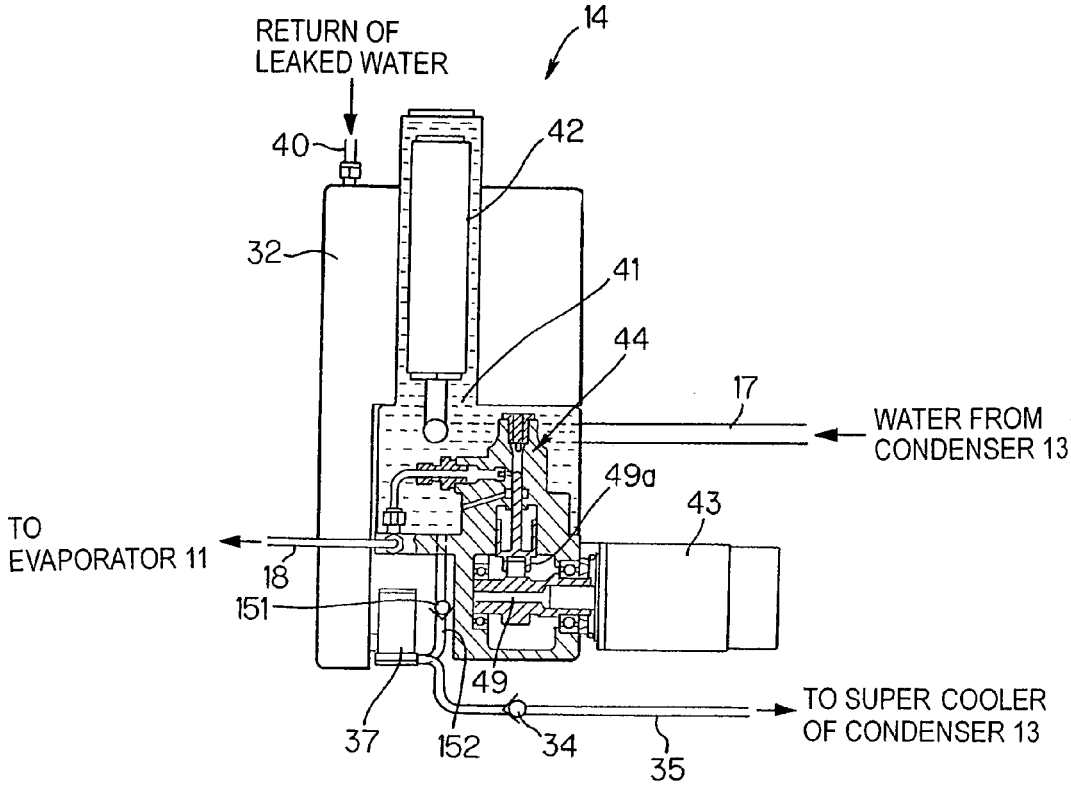
FIG. 2 is a sectional view illustrating an inner structure of a water supplying pump unit of FIG. 1.

FIG. 2 is a view showing an example specific structure of the water supplying pump unit 14.

The water supplying pump unit 14 comprises the water coalescer 42, sealed tank 41, high-pressure water supplying pump 44 driven by the drive motor 43, open tank 32, return pump 37, and check valve 34.

Although a rotation shaft 49 of the drive motor 43 is shown in the figure as being parallel to the surface of the sheet of the drawing, this is just for convenience of illustration; in practice, the rotation shaft 49 is disposed perpendicularly to the sheet of the drawing. The rotation shaft 49 of the drive motor 43 is held in engagement with a cam mechanism 49*a*, so as to function as a cam shaft.

The water coalescer 42 separates oil and water, and the sealed tank 41 directly collects leaked water from the high-pressure water supplying pump 44. The high-pressure water supplying pump 44 supplies a required amount of water by performing water amount control based on the number of pump rotations.

The open tank 32 is provided for temporarily storing water leaked out of the circulation circuitry. The return pump 37 returns the leaked water to the sealed tank 41 or to a supercooler of the condenser 13. Namely, the return pump 37 returns the leaked water from the open tank 32 to the closed tank 41 through a pipe 152 equipped with a check valve 151, or delivers the water to the supercooler of the condenser 13 through the pipe 35 equipped with the check valve 34 as necessary. The check valve 151 of the pipe 152 prevents a reverse flow of the water from the sealed tank 41, and the check valve 34 of the pipe 35 prevents a reverse flow of the water from the supercooler of the condenser 13.

Water discharged from the outlet port 13*a* (see FIG. 1) of the condenser 13 is passed through the water coalescer 42 via the pipe 17 so that the water is separated from oil and only the water is fed to the high-pressure water supplying pump 44 driven by the drive motor 43. The high-pressure water supplying pump 44 delivers the water to the evaporator 11 via the pipe 18. Leaked water is returned via the pipe 40 to the open tank 32.

Now, a description will be made about the discharge device 203, with reference to FIG. 1.

In the discharge device 203, the first relief valve 22 is positioned between the outlet of the high-pressure water supplying pump 44 and the inlet of the evaporator 11. The first relief valve 22 causes the working medium to be discharged in the water-phase state to reduce the interior pressure and then causes the vapor, having flown backward from the evaporator 11, to be discharged (relieved) in low pressure condition. Two relief circuits are provided to extend from the first relief valve 22 to the evaporator 11. The first relief circuit comprises the pipe 204 for discharging the working medium into the exhaust pipe 45 extending from the downstream end of the evaporator 11, while the second relief circuit comprises the pipe 205 for discharging the working medium into the exhaust pipe 45 extending from the upstream end of the evaporator 11.

When the first relief valve 22 has been activated, the system has to be deactivated promptly. As noted above, the first relief valve 22 causes the working medium to be discharged in the water-phase state, during an initial stage of high-pressure condition, to thereby reduce the interior pressure and then causes the vapor, having flown backward from the evaporator 11, to be discharged (relieved). Therefore, the branch pipe 200 associated with the first relief valve 22 should not be positioned very close to the evaporator 11; namely, it is preferable that the branch pipe 200 be close to the outlet of the high-pressure water supplying pump 44 and as close to the exhaust pipe 45 as possible.

When the first relief valve 22 has been activated, flows of the water and vapor within heat transmission pipes of the evaporator 11 stop at once, and then stat flowing back toward the pipe 18. Therefore, if the heat flow amount of the exhaust gas is great, then the temperature of the heat transmission pipes is likely to increase excessively. Therefore, for the discharge, via the first relief valve 22, of the water or the vapor, there are provided two discharge (relief) destinations via the first relief circuit (pipe 204); and the second relief circuit (pipe 205). The following paragraphs explain respective structural features of the first and relief circuits that function when the temperature of the heat transmission pipes has increased excessively.

(1) First Relief Circuit (Pipe 204):

Where the water etc. is discharged to the downstream exhaust pipe 45 of the evaporator 11, there is no need to provide the flow rate adjustment mechanism, such as an orifice, in the pipe 204, and thus the water-circulating circuit can be implemented using a simplest structure. Consequently, the first relief circuit can lower the pressure of the high-pressure circuit more quickly than the second relief circuit. However, when the first relief valve 22 has been activated in the first relief circuit during operation with a high heat load, the evaporator 11 would temporarily perform its heating operation without water, so that secondary damages to the heat transmission pipes might be caused due to an excessive temperature increase. Thus, there is a need to prevent an excessive heat amount from being transferred to the evaporator 11, e.g. by performing control for rapidly limiting the engine output simultaneously with activation of the first relief valve 22.

(2) Second Relief Circuit (Pipe 205):

Where the water etc. is discharged to the upstream exhaust pipe 45 of the evaporator, on the other hand, a large amount of the working medium can be emitted instantaneously toward the evaporator 11 because the destination of the working medium discharge by the relief circuit is the upstream side of the evaporator 11.

However, if the emission amount of the working medium is excessive, the heat transmission pipes and casing member of the evaporator 11 may be cooled so rapidly as to undesirably invite a possibility of deterioration of the components due to thermal impact. Thus, in the instant embodiment, the orifice 209 is provided in the pipe 205 to achieve an optimal emission amount of the working medium corresponding to the heat capacity of the evaporator 11. In this way, the instant embodiment can effectively avoid rapid cooling of the heat transmission pipes and secondary damages to the heat transmission pipes due to the excessive temperature increase although the pressure lowering speed of the high-pressure circuit may be slightly sacrificed, so that the engine output can be lowered progressively.

Further, the cooling by the second relief circuit cools the heat source (exhaust pipe 45) producing high-temperature and high-pressure vapor in the evaporator 11 and the thus-produced high-temperature and high-pressure vapor as well, and thus the vapor-phase working medium to be discharged can be further reduced in temperature and pressure.

Figure 3:
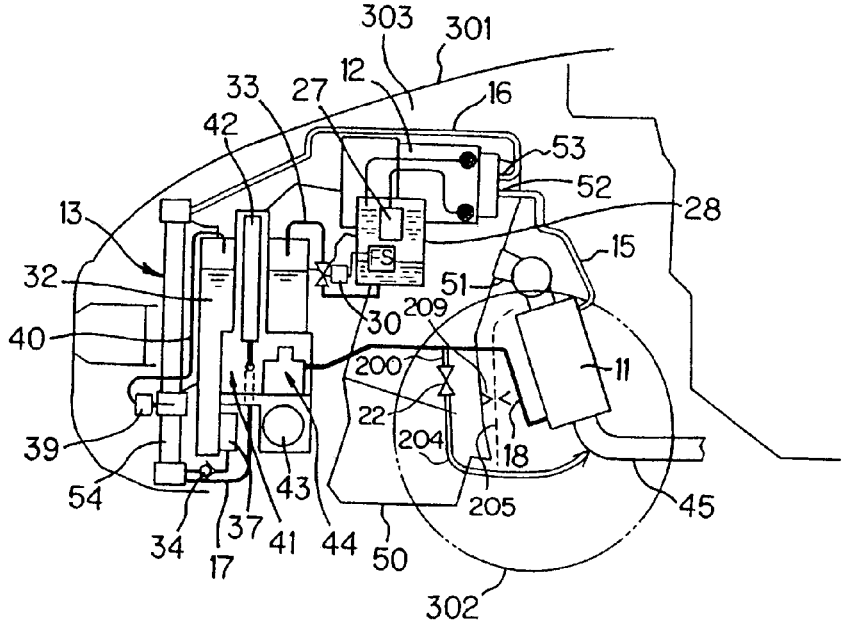
FIG. 3 is a view of example layout of various components of the Rankine cycle apparatus of FIG. 1 when mounted on a vehicle.

The following paragraphs describe the Rankin cycle apparatus 10 when mounted on the vehicle, with reference to FIG. 3.

In FIG. 3, reference numeral 301 indicates a front body of the vehicle, and 302 a front road wheel. Engine room 303 is formed within the front body 301, and the engine 50 is mounted in the engine room 303. The exhaust manifold 51 is provided on a rear surface portion of the engine 50, and the above-mentioned exhaust pipe 45 is connected to the exhaust manifold 51.

The evaporator 11 is mounted on a portion of the exhaust pipe 45 near the exhaust manifold 51. The pipe 18 extending from the high-pressure water supplying pump 44 is coupled to the evaporator 11, and the pipe 18 supplies water to the evaporator 11 using, as its heat source, the heat of exhaust gas from the high-pressure water supplying pump 44. The evaporator 11 phase-converts the water into water vapor using the heat of the exhaust gas and supplies the converted vapor to the expander 12 via the pipe 15 connected to a vapor inlet port 52 of the expander 12. The expander 12 converts expansion energy of the water vapor into mechanical energy.

The expander 12 has a vapor outlet port 53 connected to the pipe 16, and the condenser 13 for cooling/condensing water vapor into water is disposed between the pipe 16 and the sealed tank 41 leading to an inlet side of the high-pressure water supplying pump 44. The condenser 13 is located in a front area of the engine room 203. In FIG. 3, there is also shown a layout of the open tank 32, water coalescer 42, return pump 37, oil coalescer 27, super cooler 54 (liquid-phase portion of the condenser 13), air vent 39, check valve 34, etc. The high-pressure water supplying pump 44, evaporator 11, expander 12, condenser 13, etc. together constitute the Rankine cycle apparatus for converting heat energy into mechanical energy, as noted above.

Behavior of the Rankine cycle apparatus is explained below in the order that corresponds to the flows of water and water vapor within the Rankine cycle apparatus.

Water cooled and condensed in the condenser 13 is supplied, in a pressurized condition, by the high-pressure water supplying pump 44 to the evaporator 11 via the pipe 18.

The water, which is a liquid-phase working medium, is heated by the evaporator 11 imparting the water with heat energy until it becomes high-temperature and high-pressure water vapor, and the resultant high-temperature and high-pressure water vapor is supplied to the expander 12. The expander 12 converts the heat energy into mechanical energy through expanding action of the high-temperature and high-pressure water vapor, and the mechanical energy is supplied to the motor/generator 19 annexed to the expander 12.

The water vapor let out from the expander 12 assumes a lowered temperature and pressure, which is then delivered to the condenser 13. The water vapor of lowered temperature and pressure delivered to the condenser 13 is again cooled and condensed in the condenser 13, and the resultant condensed water is supplied via the water coalescer 42 to the high-pressure water supplying pump 44. After that, the water, which is a liquid-phase working medium, repeats the above circulation, so that the expander 12 continues to be supplied with water vapor of high temperature and pressure.

Figure 4:
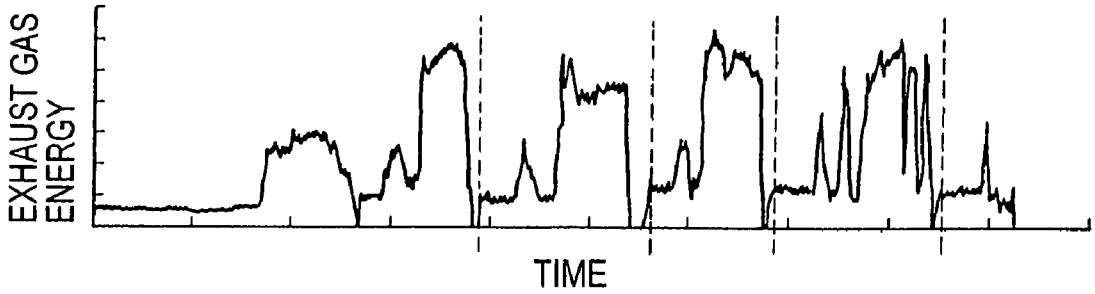
FIG. 4 is a graph showing variation over time of exhaust gas energy.
Figure 5:
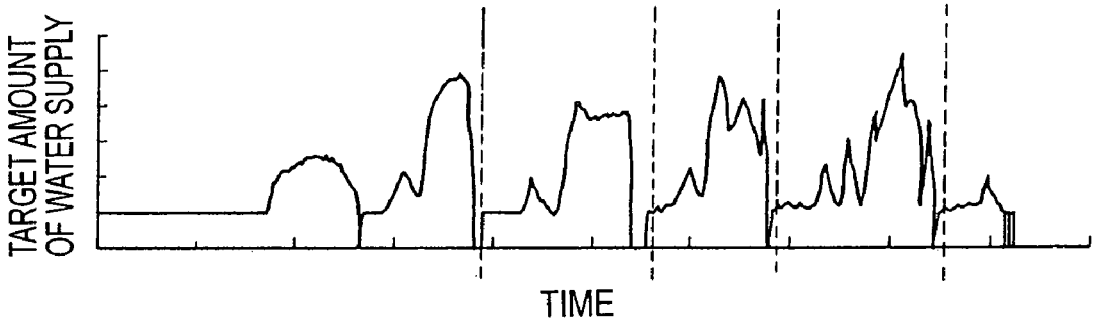
FIG. 5 is a graph showing variation over time of a target amount of water supply.
Figure 6:
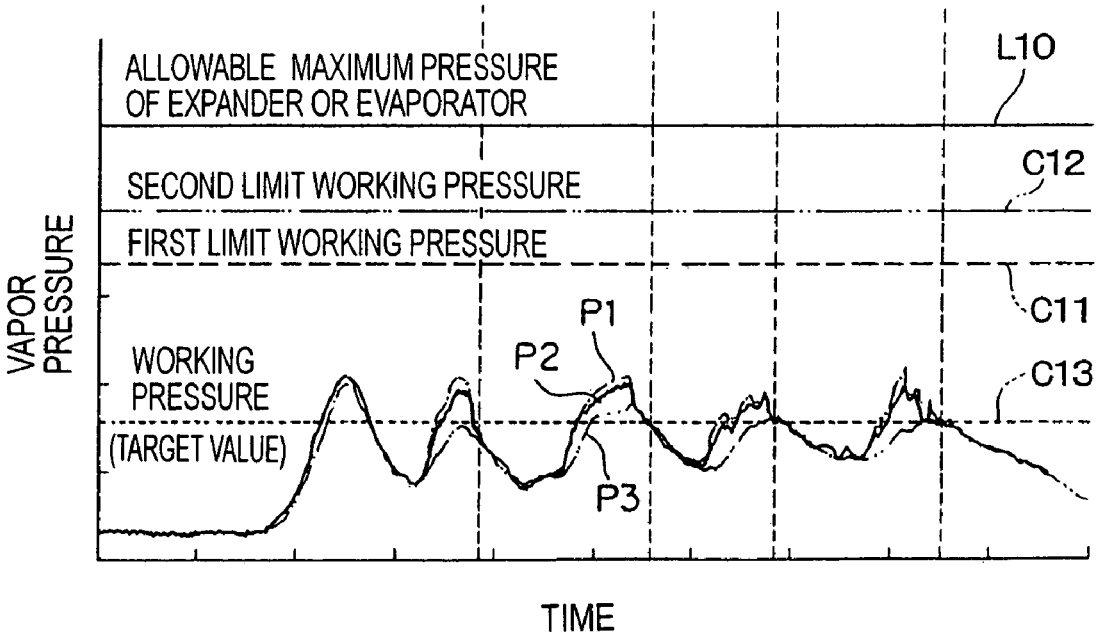
FIG. 6 is a graph showing variation over time of a vapor pressure.

Next, a description will be made about settings of respective working pressures of the first and second relief valves 22 and 202 of the discharge valve device 203, with reference to FIGS. 4–6. FIG. 4 is a graph showing variation over time in exhaust gas energy, FIG. 5 is a graph showing variation over time in target water supply amount, and FIG. 6 is a graph showing variation over time in vapor pressure.

The exhaust gas energy varies as illustrated in FIG. 4 in response to start and stop operations of the vehicle. The vapor pressure varies as depicted by curves P1, P2 and P3 of FIG. 6 in response to variation in the exhaust gas energy and target water supply amount of FIG. 5. Straight line L10 of FIG. 6 represents an allowable maximum pressure level of the expander or evaporator. Thus, the working pressures of the relief valves are set to be higher than a normal working pressure C13, as represented by a first limit working pressure (straight line C11) and second limit working pressure (straight line C12).

Where only the second relief valve 202 is used solely, its working pressure is set to the first limit working pressure C11 that is about twice as great as the normal system working pressure C13 of the Rankine cycle apparatus 10. Thus, the second relief valve 202 functions to reduce only an excessive pressure while maintaining the system working pressure, so that the appropriate operation of the Rankine cycle apparatus 10 can be maintained reliably. Relief circuit associated with the second relief valve 202 is constructed by connecting the relief valve 202 to the exhaust pipe 45 via the pipe 207 as shown in FIG. 1, and by connecting the relief valve 202 to the open tank 32 via the pipe 208 so that the working medium can be recovered for recycling.

Where only the first relief valve 22 is used solely, its working pressure is set to the second limit working pressure C12 that is about twice and half as great as the normal system working pressure C13 of the Rankine cycle apparatus 10. Thus, the first relief valve 22 reliably performs the pressure release operation at or below an allowable maximum pressure level close to upper pressure level limits of the evaporator and expander, so that the evaporator and expander can be reliably protected from excessive pressure; the operations of these components can be readily resumed after replacement of a rupture disk of the first relief valve 22.

Further, where the first and second relief valves 22 and 202 are used in combination, each of these relief valves 22 and 202 is set to the same working pressure as in the case where it is used solely as mentioned above. In this way, fail-safe protection can be achieved against erroneous operation or malfunction of each of the relief valves 22 and 202.

Figure 7:
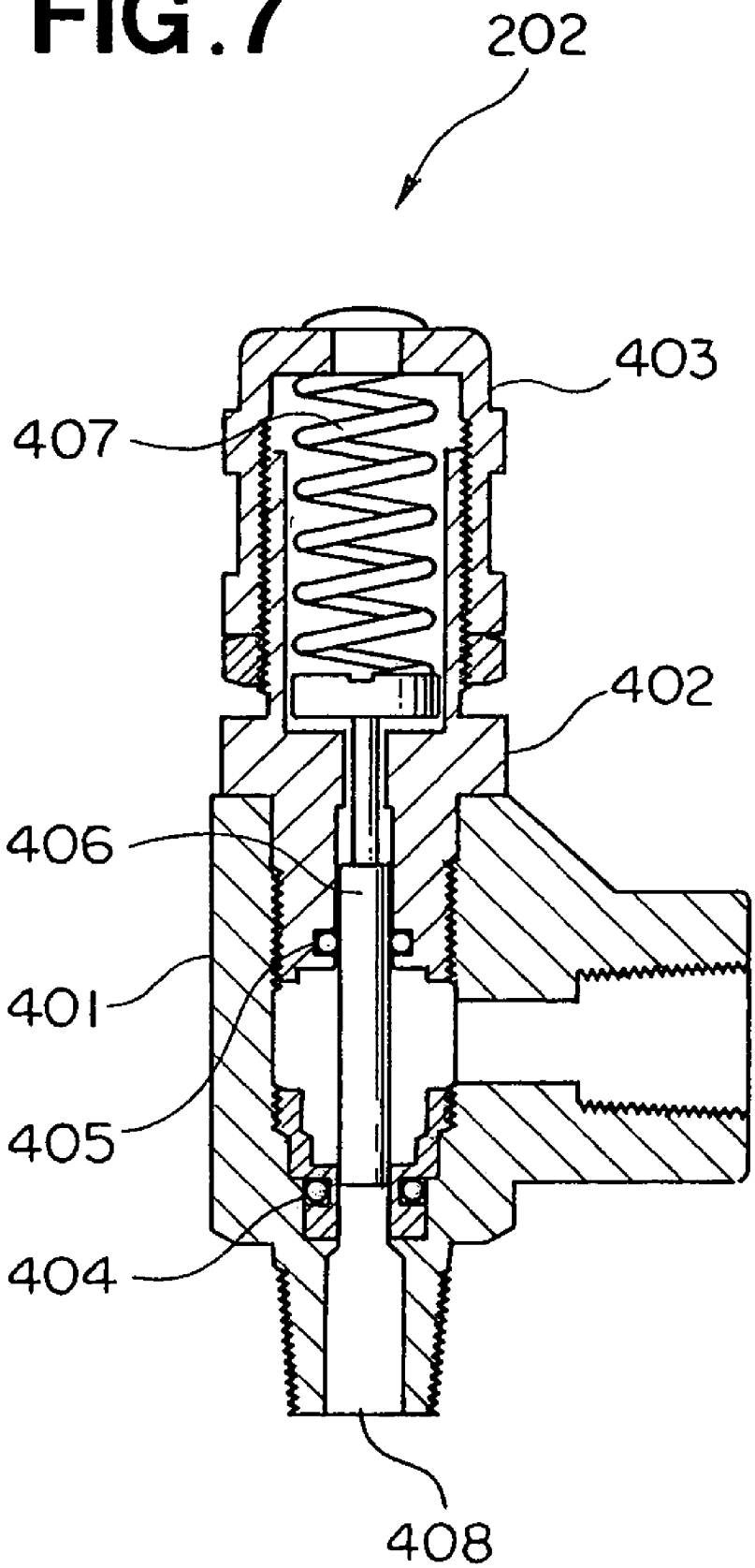
FIG. 7 is a vertical sectional view showing a specific example of a second relief valve in the Rankine cycle apparatus.
Figure 8:
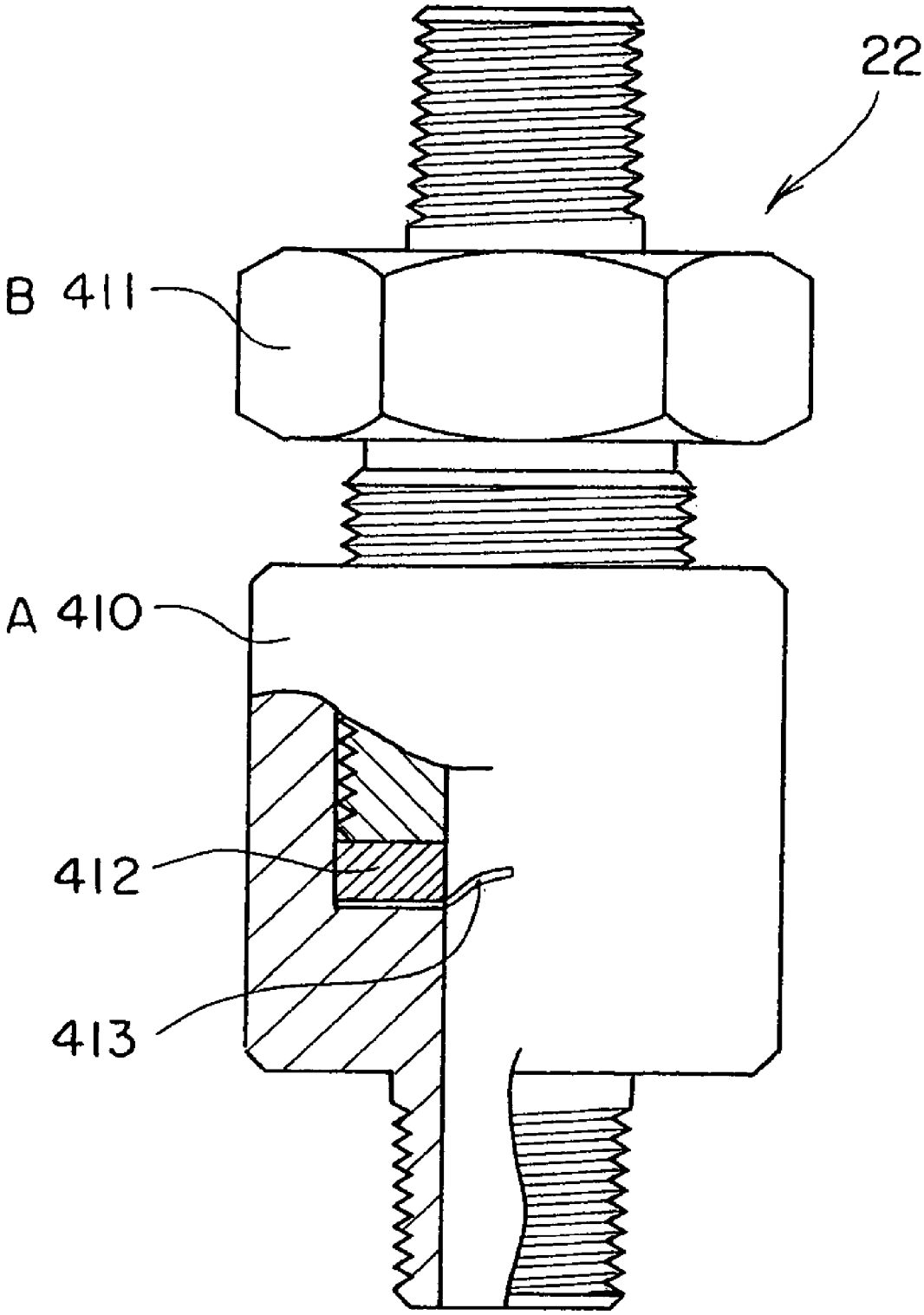
FIG. 8 is a partly-sectional view showing a specific example of a first relief valve in the Rankine cycle apparatus, which is of a rupture-type.

FIG. 7 is a vertical sectional view of the second relief valve 202, which includes a valve body 401, a valve support 402 screwed to the valve body 401, and a cap 403 screwed to the valve support 402. Axial valve member 406 is vertically-movably supported via an O-ring 404 and sealing member 405 and normally resiliently urged by a spring 407 disposed in an upper portion of the second relief valve 202. Once a pressure externally applied to the interior of a pipe opening 408 exceeds a reference value preset for the second relief valve 202, the applied pressure causes the axial valve member 406 to press at its upper end the spring 407 so that a gap is formed, between the O-ring 404 and the axial valve member 406, to permit leakage through the gap FIG. 8 is a partly-sectional view of one embodiment of the first relief valve 22 which is constructed as a rupture-type relief valve. The first relief valve 22 includes a first holder 410, a second holder 411, and a rupture disk 413 supported by a back-up ring 412 within the first holder 410.

Figure 9A:
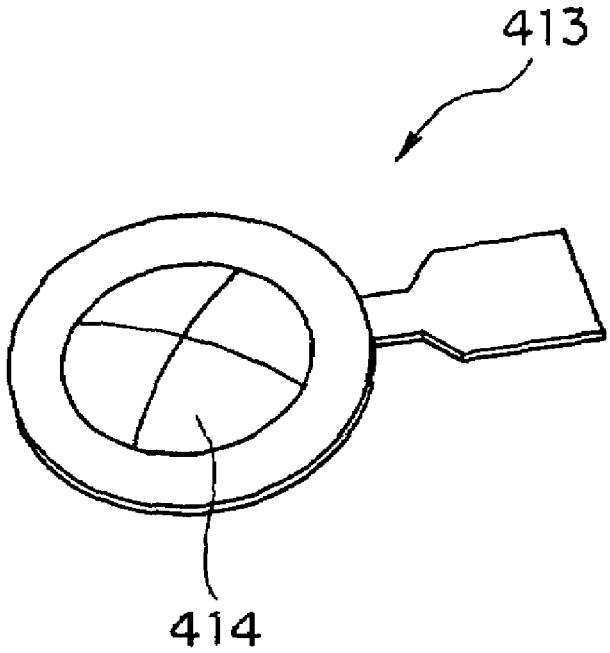
FIGS. 9A and 9B are perspective views of a rupture disk of the rupture-type relief valve shown in FIG. 8.
Figure 9B:
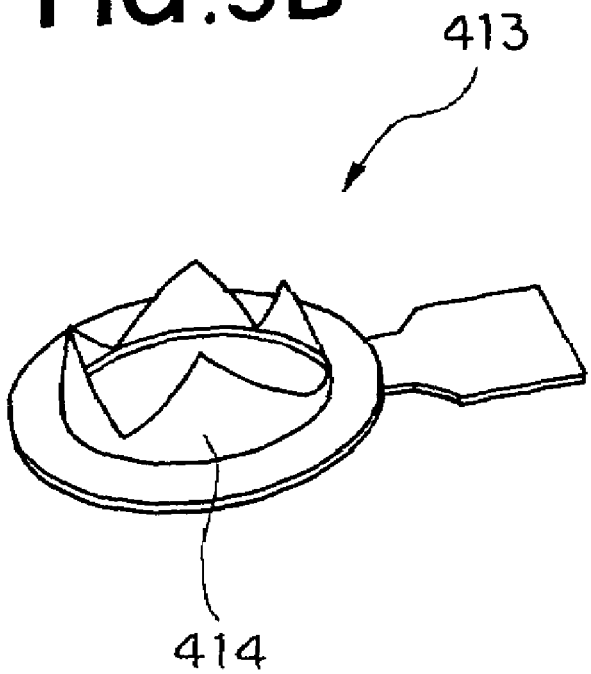

As shown in FIGS. 9A and 9B, the rupture disk 413 has a central disk portion 414 that opens to permit leakage therethrough when a pressure greater than a predetermined level is applied thereto (FIG. 9B).

Next, a description will be made about control of the liquid level position of water accumulated in the condenser 13 of the Rankine cycle apparatus 10, with reference to FIGS. 10–18.

Figure 10:
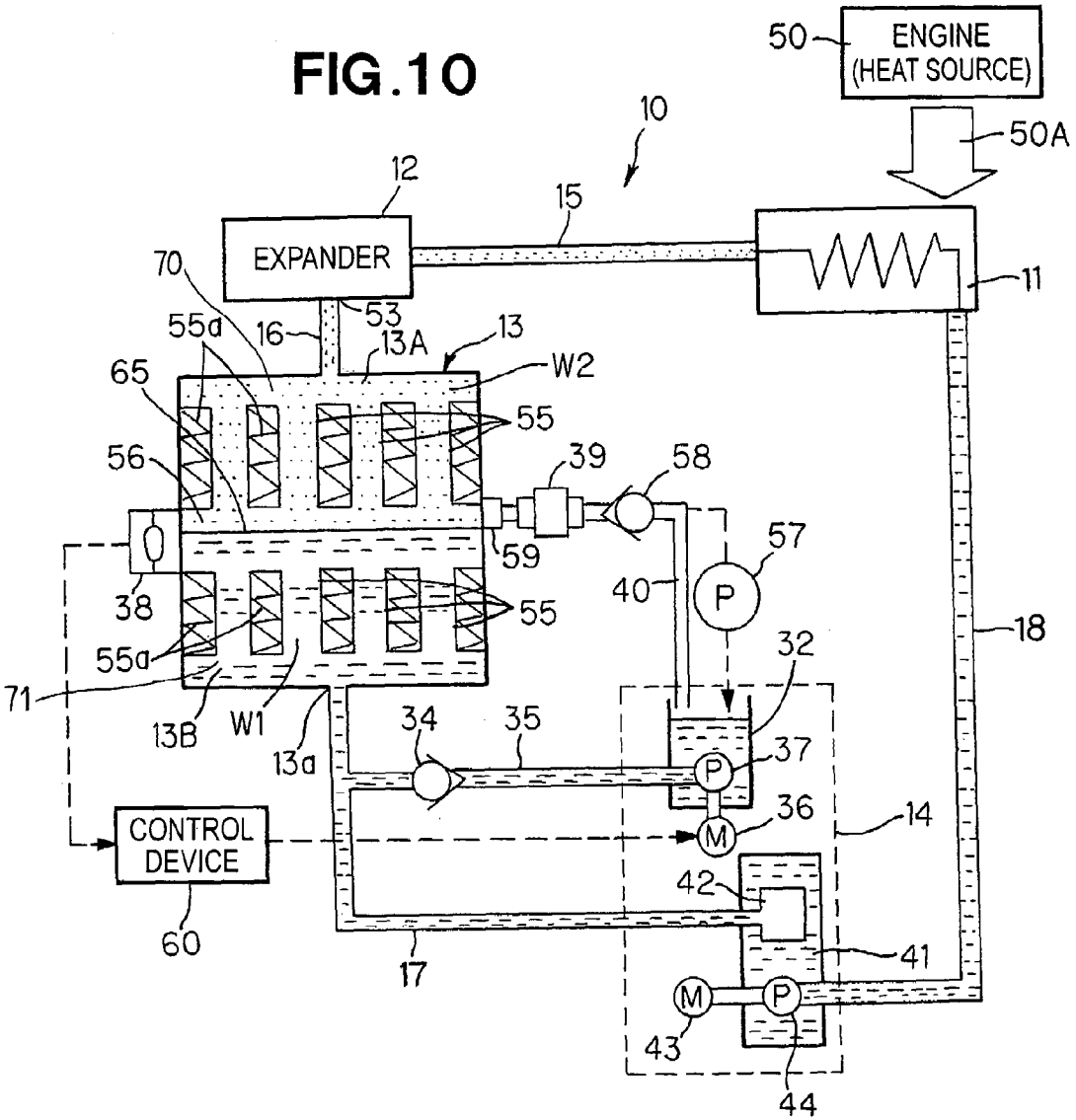
FIG. 10 is a block diagram showing a system setup of the Rankine cycle apparatus, which particularly shows flows of a working medium in the apparatus.
Figure 11:
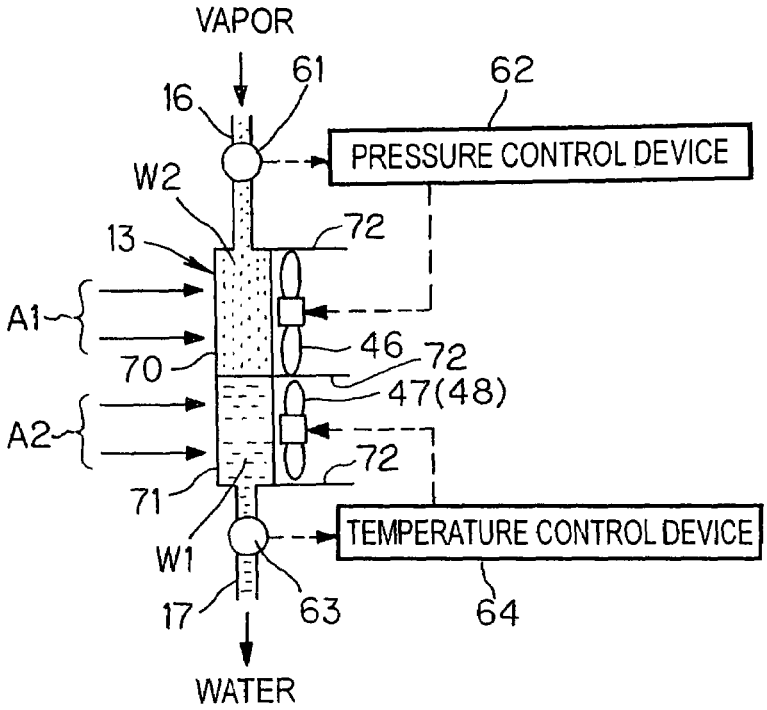
FIG. 11 is a side view showing an inner structure of a condenser and other components peripheral to the condenser in the Rankine cycle apparatus of FIG. 1.

FIG. 10 shows the system of the Rankine cycle apparatus 10 with a central focus on the condenser 13, which particularly shows a front view of the condenser 13 as taken from before the vehicle; more specifically, states of the working medium (water or condensed water W1 and water vapor W2) within the condenser 13 are illustrated. FIG. 11 is a side view of the cooling device condenser 13, which shows positional relationship among cooling fans 46, 47 and 48 provided for the condenser 13 as well as inner states of the condenser 13.

The condenser 13 includes a vapor introducing chamber 13A in its upper end portion, a water collecting chamber 13B in its lower end portion, and an intermediate chamber 56. A plurality of cooling pipes 55 are provided between the vapor introducing chamber 13A and the intermediate chamber 56 and between the intermediate chamber 56 and the water collecting chamber 13B, and these three chambers 13A, 13B and 56 are in fluid communication with each other. Cooling fins 55*a* are provided on the outer periphery of the cooling pipes 55.

The vapor introducing chamber 13A of the condenser 13 is connected via the pipe 16 to the vapor outlet port 53 of the expander 12, and the water collecting chamber 13B is connected via the pipe 17 to the water supplying pump unit 14. As noted earlier, the expander 12 is connected via the pipe 15 to the evaporator 11, and the water supplying pump unit 14 is connected via the pipe 18 to the evaporator 11.

The evaporator 11 receives heat 50A from the exhaust gas of the engine (heat source) 50 via the exhaust pipe 45 (see FIG. 1). Within the water supplying pump unit 14, there are included various components, such as the sealed tank 41, water coalescer 42, high-pressure water supplying pump 44, drive motor 43, open tank 32, return pump 37 and motor 36.

In the condenser 13, water vapor W2 is cooled and condensed to turn to water (condensed water) W1 and accumulated in a lower inner portion of the condenser 13. Horizontal line drawn in the figure within the intermediate chamber 56 represents a liquid level 65 (corresponding to the liquid level position P1 of FIG. 1) that indicates a liquid level position of the water W1 accumulated in the condenser 13.

The liquid level sensor 38 and intermediate discharge port 59 are provided at a position corresponding to the position of the liquid level 65. The liquid level sensor 38 outputs a detection signal, representative of the liquid level position detected thereby, to a control device 60. The control device 60 generates a motor control instruction signal on the basis of the liquid level position detection signal from the sensor 38 and sends the motor control instruction signal to the motor 36 of the return pump 37.

The air vent 39 for water vapor is coupled to the intermediate discharge port 59, and it has an output end communicating with the open tank 32 via the pipe 40 equipped with a check valve 58. Exhaust pump 57 is annexed to the pipe 40 in parallel relation thereto.

Further, as seen in FIG. 11, the cooling fan 46 is disposed adjacent the rear surface (right side surface in the figure) of the condenser 13 in corresponding relation to a gaseous-phase portion or vapor condensing portion 70 of the condenser 13 where the vapor W2 is accumulated, and the cooling fans 47 and 48 are disposed adjacent the rear surface of the condenser 13 in corresponding relation to a liquid-phase portion or condensed water cooling portion 71 of the condenser where the water W1 is accumulated.

The cooling operation by the cooling fan 46 is controlled by a pressure control device 62 on the basis of a vapor pressure detection signal output by a pressure sensor 61 mounted, for example, on the pipe 16 through which the vapor W2 flows. Namely, the cooling fan 46 is a vapor-condensing cooling fan to be used for vapor pressure adjustment. Further, the cooling operations by the cooling fans 47 and 48 are controlled by a temperature control device 64 on the basis of a water temperature detection signal output by a temperature sensor 63 mounted, for example, on the pipe 17 through which the water W1 flows. Namely, the cooling fans 47 and 48 are water-cooling fans to be used for cooling of the condensed water.

In FIG. 11, A1 indicates a flow of cooling air applied from before the gaseous-phase portion 70 of the condenser 13 on the basis of the rotation of the cooling fan 46, while A2 indicates a flow of cooling air applied from before the liquid-phase portion 71 of the condenser 13 on the basis of the rotation of the cooling fans 47 and 48.

As apparent from the foregoing, the gaseous-phase portion or vapor condensing portion 70 and the liquid-phase portion or condensed water cooling portion 71 in the condenser 13 are cooled independently of each other. Reference numeral 72 represents shrouds that zone or define the individual cooling regions.

Referring back to FIG. 10, the water vapor discharged from the vapor outlet port 53 of the expander 12 is substantially equivalent in pressure to the atmospheric pressure. In the intermediate chamber 56 into which the respective outlets of the upper cooling pipes (condensing pipes) 55 open, water is discharged via the air vent 39 in order to adjust the liquid level 65 to lie within the intermediate chamber 56. Further, the high-pressure water supplying pump 44 functions, as a water supplying pump of a main circulation circuit in the Rankine cycle apparatus 10, to supply a necessary amount of water to the evaporator 11.

The reserving open tank 32, which is open to the atmospheric air, retains reserve water for the sealed circulation circuitry in the system. The return pump 37 supplies water into the condenser 13 in response to the detection signal from the liquid level sensor 38. The exhaust pump 57 sucks in air from the downstream end of the air vent 39 when the condenser 13 is to be operated at a negative pressure.

The above-mentioned exhaust pump 57 may be constructed to operate in response to detection of a negative pressure by the pressure sensor 61 and pressure control device 62 shown in FIG. 11, or by the control device 60 detecting via the liquid level sensor 38 when the position of the liquid level 65 rises above a predetermined upper limit.

The check valve 58 prevents a reverse flow of the atmospheric air when the interior pressure of the condenser 13 turns to a negative pressure, and the check valve 34 prevents a reverse flow of water from the condenser 13 to the return pump 37. The air vent 39 is constructed to allow water and air to pass therethrough, but prevent water vapor from passing therethrough. The intermediate discharge port 59 functions to limit variation in the position of the liquid level 65 of the condensed water, through emission of non-condensing gas or overflow of the water, so that the liquid level position varies only within a predetermined vertical range.

The liquid sensor 38 outputs a position detection signal, representative of an actual current position of the liquid level 65, to the control device 60, and the control device 60 controls the return pump 37 so that the position of the liquid level 65 constantly lies within the intermediate chamber 56. More specifically, the position of the liquid level 65 is controlled to lie within a predetermined vertical range between the air vent 39 and the liquid level sensor 38. The liquid level sensor 38 may be, for example, in the form of a capacitance-type level sensor or float-type level switch.

In FIG. 11, the pressure sensor 61 detects an interior pressure of the condenser 13; basically, it detects a pressure of the water vapor W2. The pressure control device 62 operates the cooling fan 46 in such a manner that the interior pressure of the condenser 13 equals a predetermined pressure setting. The temperature sensor 63 detects a current temperature of the condensed water W1. The temperature control device 64 operates the cooling fans 47 and 48 in such a manner that the condensed water temperature equals a predetermined temperature setting.

Figure 12:
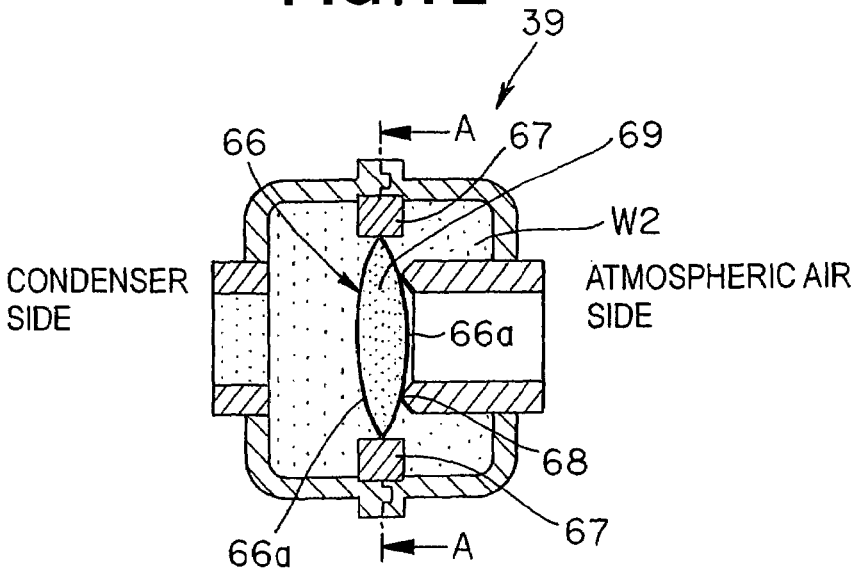
FIG. 12 is a sectional view showing a structure of an air vent in its closed position.
Figure 13:
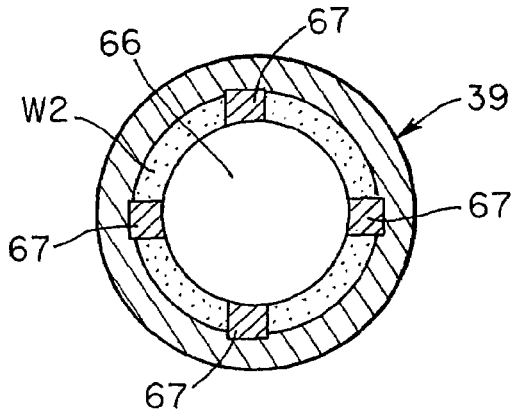
FIG. 13 is a sectional view of the air vent taken along the A—A lines of FIG. 12.
Figure 14:
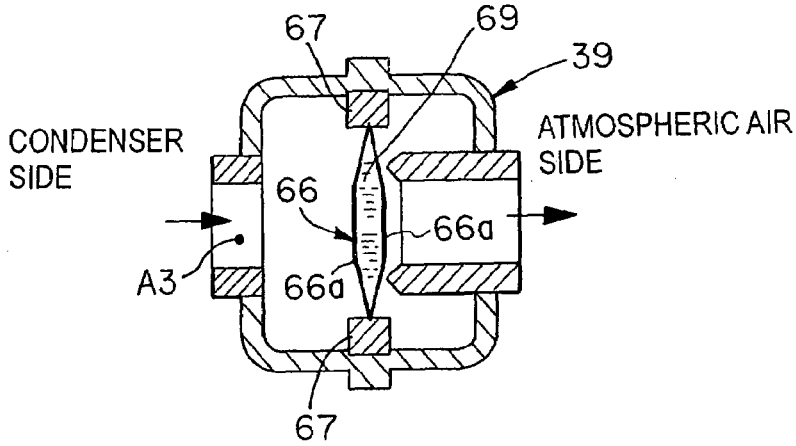
FIG. 14 is a sectional view of the air vent in an opened position.

Next, construction and behavior of the air vent 39 employed in the instant embodiment will be detailed with reference to FIGS. 12 to 14. FIG. 12 is a vertical sectional view of the air vent 39 and FIG. 13 is a sectional view of the air vent 39 taken along the A—A lines of FIG. 12, both of which show the air vent 39 in a closed position. FIG. 14 is a vertical sectional view of the air vent 39 in an opened position (valve-open position). In FIG. 12, the left side of the air vent 39 is a side communicating with the condenser 13 (i.e., "condenser side"), while the right side of the air vent 39 is a side communicating with the atmosphere (i.e., "atmospheric air side"). The air vent 39 is hermetically sealed when its interior is filled with saturated vapor (FIG. 12), automatically opened when water or non-condensing gas is present in the interior, and again hermetically sealed by discharging the water or non-condensing gas (FIG. 14).

In FIG. 12, the air vent 39 includes a valve 66 located generally centrally therein, a valve support 67 supporting the valve 66, and a valve port (packing) 68.

The valve 66 supported by the valve support 67 is positioned to close up the valve port 68 when necessary. The valve 66 comprises a pair of opposed diaphragms 66*a* combined to form a hermetically-sealed space therebetween, and temperature-sensitive liquid 69 is held in the sealed space. The temperature-sensitive liquid 69 has characteristics such that, like water, it is kept in the liquid phase under less than a predetermined pressure or temperature but expands as a gas once the temperature exceeds a predetermined level.

Figure 15:
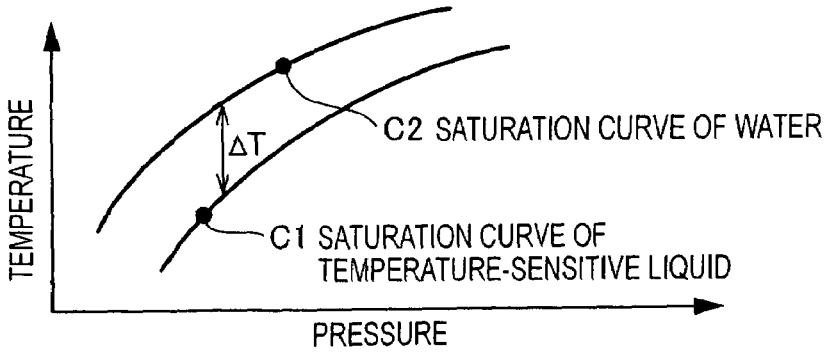
FIG. 15 is a graph showing respective saturation curves of a temperature-sensitive liquid and water.

FIG. 15 shows respective saturation curves C1 and C2 of the temperature-sensitive liquid 69 and water. The temperature at which the temperature-sensitive liquid 69 turns to the gaseous state is lower by ΔT (about 10° C.) than the temperature at which water turns to water vapor. Thus, when the interior of the air vent 39 is filled with the water vapor W2, the temperature-sensitive liquid 69 is kept in the gaseous state, so that the sealed space containing the expanded temperature-sensitive liquid 69 presses the opposed diaphragms 66*a* outwardly away from each other so as to close up a gap between the valve port 68 and the valve 66 comprised of the diaphragms 66*a* (see FIG. 12). Conversely, when the interior of the air vent 39 is at a low temperature (e.g., when non-condensing gas A3, such as air, is present in the ambient environment around the valve 66), the temperature-sensitive liquid 69 is kept in the liquid state, the opposed diaphragms 66*a* are pressed inwardly toward each other, so that air etc. is discharged through the gap between the valve 66 and the valve port 68 (see FIG. 14).

As apparent from the foregoing, the control device 60 shown in FIG. 10 is constructed to control the position of the liquid level 65 to vary only within the predetermined vertical range (variation width) in the condenser 13 that cools the water vapor W2 via the cooling fan 46 to convert the vapor W2 back to the water (condensed water) W1. When the detection signal output from the liquid level sensor 38, which detects a current position of the liquid level 65 that corresponds to the boundary between the gaseous-phase portion 70 and the liquid-phase portion 71 (see FIG. 10) in the condenser 13, indicates that the position of the liquid level 65 is lower than the lower limit of the predetermined range, the control device 60 controls the motor 36 of the return pump 37 that supplies water into the condenser 13, to thereby re-supply or replenish a deficient amount of water from the open tank 32 via the pipe 35 to the condenser 13.

Further, when the position of the liquid level 65 is higher than the upper limit of the predetermined range, the control device 60 discharges an excessive water to the open tank 32 via the intermediate discharge port 59, air vent 39, etc. In this way, a desirable range of the position of the liquid level 65 can be set in accordance with the range determined by the lower limit based on the detection by the liquid level sensor 38 and the upper limit based on the operation of the air vent 39.

The intermediate discharge port 59 for discharging the water (condensed water) W1 is provided in the intermediate chamber 56 of the condenser 13, in order to control the position of the liquid level 65. When the liquid level 65 is higher than the intermediate discharge port 59, the intermediate discharge port 59 causes the water to flow out therethrough to the reserving open tank 32 so that the liquid level 65 can be lowered. When the liquid level 65 is lower than the intermediate discharge port 59, the air vent 39 coupled to the intermediate discharge port 59 prevents the vapor from escaping via the water outlet 59.

As seen in FIGS. 12–14, the air vent 39 for preventing the vapor from escaping via the intermediate discharge port 59 automatically closes the valve when vapor is present in its interior, but automatically opens the valve when air (non-condensing gas) or water is present.

Further, as seen in FIG. 10, the liquid level sensor 38 is provided at a position lower than the intermediate discharge port 59, and, when the position of the liquid level 65 has lowered below the liquid level sensor 38, a deficient amount of water is re-supplied or replenished from the open tank 32 by means of the return pump 37, so as to raise the liquid level 65 to the position of the liquid level sensor 38.

As set forth above, the position of the liquid level 65 is constantly kept within the vertical range between the intermediate discharge port 59 and the liquid level sensor 38. If the interval is distance between the intermediate discharge port 59 and the liquid level sensor 38 is increased, an error in heat transmission area between the vapor portion W2 and the water (condensed water) portion W1 will become greater. Conversely, if the interval between the intermediate discharge port 59 and the liquid level sensor 38 is decreased, the return pump 37 and air vent 39 have to operate very often. Therefore, it is preferable that the interval between the intermediate discharge port 59 and the liquid level sensor 38 be set within a moderate range such that both of the above two adverse influences or inconveniences can be lessened to an appropriate degree. Further, in order to keep constant the heat transmission areas, it is desirable that the interval between the intermediate discharge port 59 and the liquid level sensor 38 be as small as possible or zero.

FIG. 16A shows positional relationship among the liquid level sensor 38, the air vent 39 and the liquid level 65 in the Rankine cycle apparatus, and FIG. 16B shows relationship among the liquid level 65 and operational states of the air vent 39 and return pump 37.

In FIG. 16A, $H_A$, $H_B$ and $H_L$ represent the upper-limit position of the liquid level, lower-limit liquid level and position of the liquid level 65, respectively. When the actual position $H_L$ of the liquid level 65 is higher than the upper-limit position $H_A$, the air vent 39 is set in its opened position, and the return pump 37 (see FIG. 10) is set in its OFF state. When the position $H_L$ of the liquid level 65 is between the upper-limit and lower-limit positions $H_A$ and $H_B$ of the liquid level, the air vent 39 is set in its closed position (valve-closed position), and the return pump 37 is set in its OFF state. When the position $H_L$ of the liquid level 65 is lower than the lower-limit positions $H_B$, the air vent 39 is set in its closed position, and the return pump 37 is set in its ON state. In this way, variation in the liquid level 65 can be reliably confined within the range between the upper-limit and lower-limit positions $H_A$ and $H_B$.

Also, even when the inflow amount (mass flow rate) of water vapor or the amount of water discharge (mass flow rate) to the high-pressure water supplying pump 44 varies at the time of activation/deactivation or transient variation of the Rankine cycle apparatus 10, the described arrangements of the instant embodiment can effectively restrict or control variation of the position of the liquid level 65 within the condenser 13 and thereby permits stable operation of the condenser 13.

Further, as illustrated in FIG. 10, the Rankine cycle apparatus 10 includes the reserving open tank 32 open to the atmosphere and provided separately from the main circulation circuit. This open tank 32 is connected to the condenser 13, via the air vent 39 coupled to the intermediate discharge port 59 and the check valve 58. Lower portion of the open tank 32 is connected to the outlet port 13*a* of the condenser 13 via the return pump 37, pipe 35 and check valve 34.

When the liquid level 65 is higher in position than the intermediate discharge port 59, the water overflows out of the condenser 13 to be directed into the open tank 32, while, when the liquid level 65 is lower in position than the liquid level sensor 38, the return pump 37 is activated to replenish water to the condenser 13. Because the amount of water supply by the high-pressure water supplying pump 44, located downstream of the condenser 13, is controlled in the instant embodiment, the activation of the return pump 37 causes the liquid level 65 to rise up to the position of the liquid level sensor 38 due to the water supply into the condenser 13, upon which the return pump 37 is deactivated.

Further, because the intermediate chamber 56, into which the plurality of cooling pipes (condensing pipes) 55 open, is provided in the region including the intermediate discharge port 59 and liquid sensor 38, the liquid level 65 is allowed to vary with improved response and in a stabilized manner during water discharge from the intermediate discharge port 59 or water supply from the return pump 37.

Note that the provision of the intermediate chamber 56 is not necessarily essential to the present invention as long as the vapor introducing chamber 13A and water collecting chamber 13B are in fluid communication with each other via the plurality of cooling pipes (condensing pipes) 55.

Operational sequence of the liquid level position control performed by the control device 60 is explained below with reference to a flow chart of the FIG. 17.

At step S10, the control device 60 reads the current position $H_L$ of the liquid level 65 via the liquid level sensor 38.

At step S11, it is determined whether the liquid level position $H_L$ is higher than the upper-limit position $H_A$ of the liquid level, and, if so, control proceeds to step S12, where the air vent 39 is brought to its opened position to discharge the excessive water so as to lower the liquid level 65. After that, the control device 60 reverts to step S10. When the liquid level position $H_L$ is lower than the upper-limit position $H_A$ of the liquid level, control proceeds to step S13 in order to close the air vent 39.

At step S14, it is determined whether the liquid level position $H_L$ is lower than the lower-limit position $H_B$ of the liquid level, and, if so, control proceeds to step S15, where the return pump 37 is turned on for re-supply or replenishment of deficient water. Further, if the liquid level position $H_L$ is higher than the lower-limit position $H_B$ of the liquid level, the return pump 37 is turned off to not replenish water. After that, the control device 60 reverts to step S10.

Figure 18:
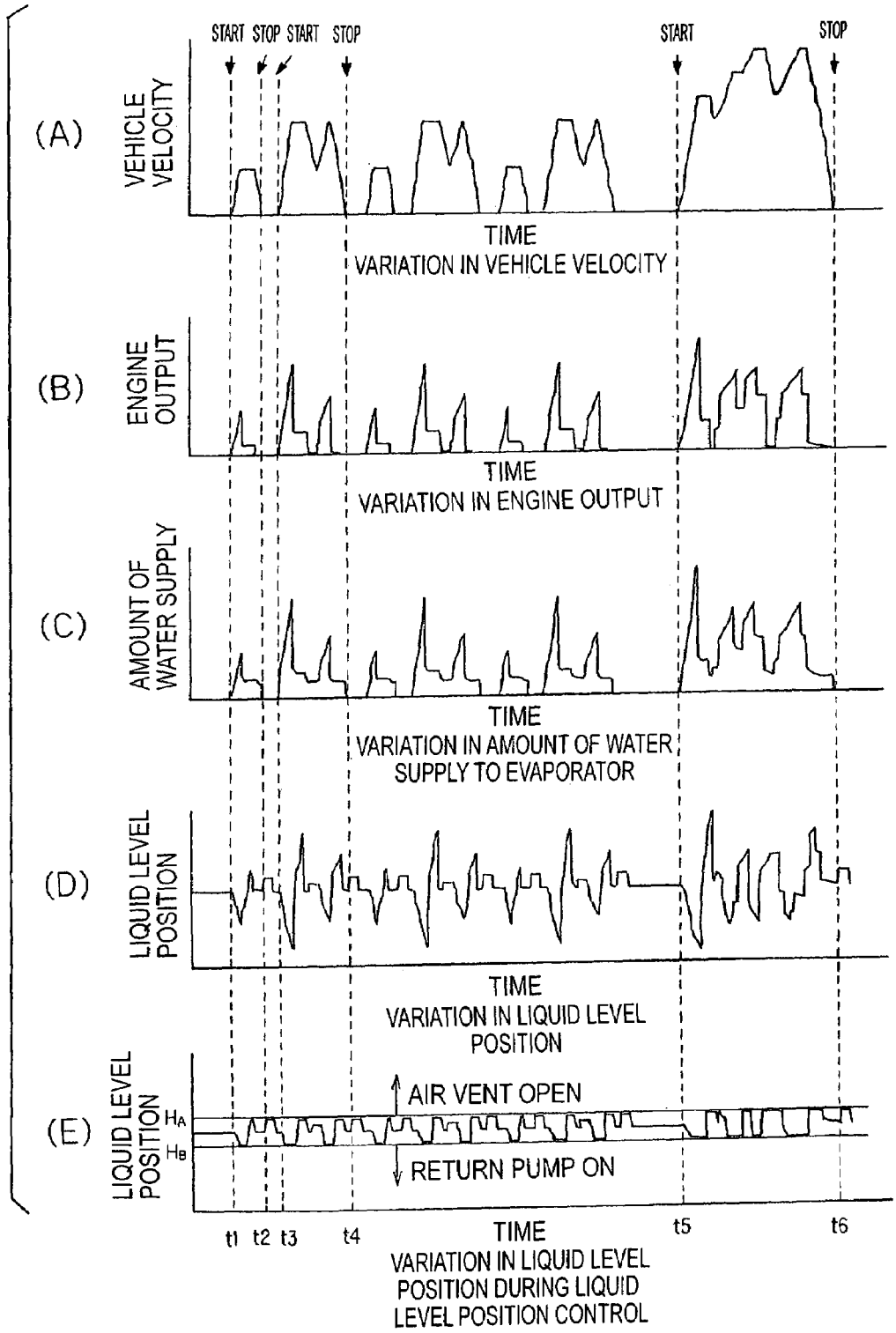
FIG. 18 is a timing chart showing variation in a traveling velocity of the vehicle having the Rankine cycle apparatus mounted thereon, variation in an engine output, variation in an amount of water supply to an evaporator and variation in the liquid level position within the condenser.

FIG. 18 is a timing chart showing variation in the velocity of the vehicle having the Rankine cycle apparatus 10 mounted thereon, variation in the engine output, variation in the amount of water supply to the evaporator and variation in the liquid level position within the condenser, in contradistinction to the conventional apparatus. More specifically, section (A) of FIG. 18 shows variation in the traveling velocity of the vehicle, (B) variation in the engine output of the vehicle, (C) variation in the amount of water supply to the evaporator in the conventional apparatus, (D) variation in the liquid level position within the condenser in the conventional apparatus, and (E) variation in the liquid level position within the condenser in the embodiment of the present invention.

As the velocity of the vehicle, having the Rankine cycle apparatus mounted thereon, varies as illustrated in (A) of FIG. 18, the engine output of the vehicle varies as illustrated in (B) of FIG. 18, in response to which the amount of water supply to the evaporator varies in a manner as illustrated in (C) of FIG. 18 and also the liquid level position within the condenser varies in a manner as illustrated in (D) of FIG. 18. In other words, as the vehicle starts traveling at time points t1, t3 and t5 and stops traveling at time points t2, t4 and t6 along the time axis, the engine output varies and the amount of water supply to the evaporator also varies, so that the liquid level position within the condenser varies.

Figure 19:
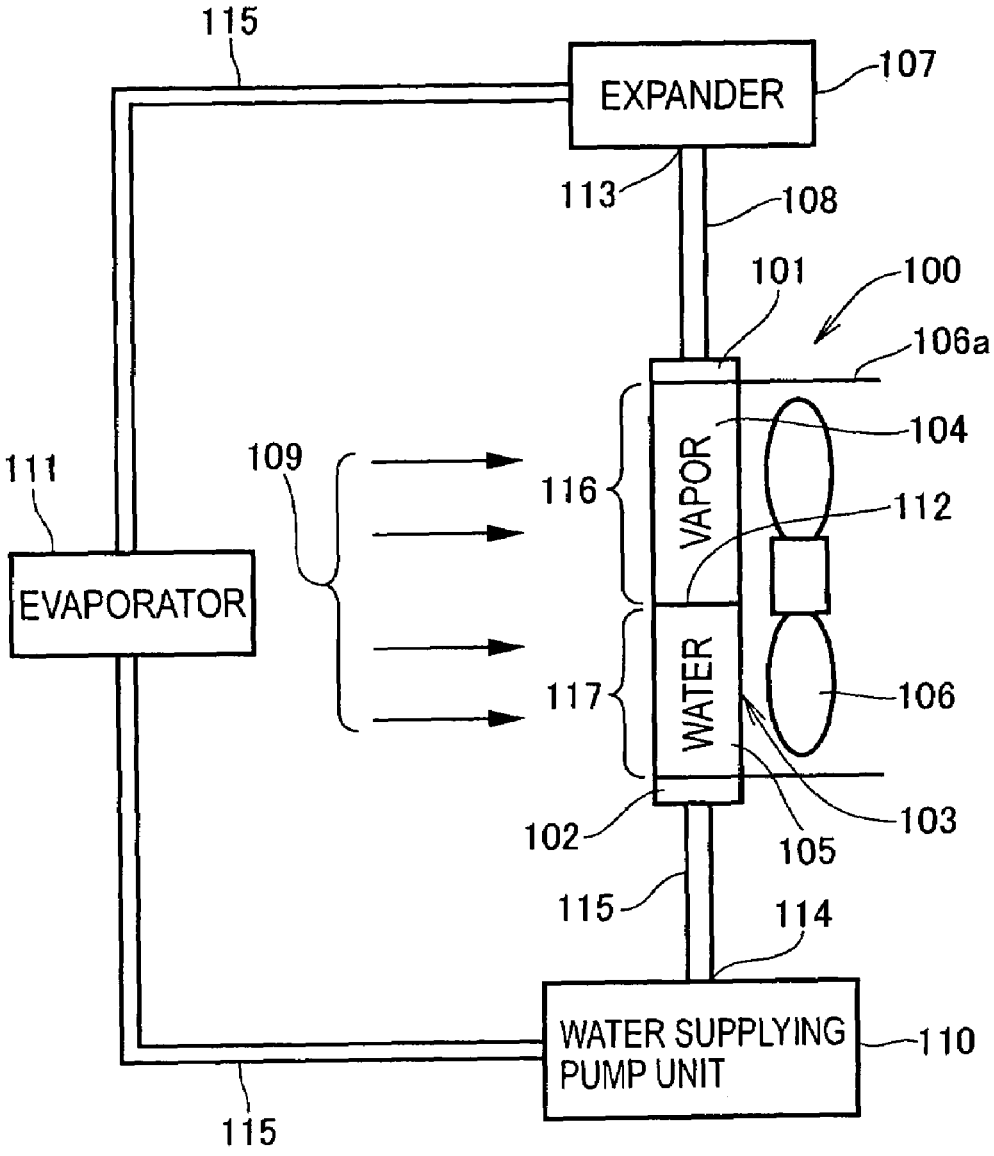
FIG.19 (PRIOR ART)
FIG. 19 is a schematic view of a conventional vehicle-mounted Rankine cycle apparatus.

With the condenser 100 of the conventional vehicle-mounted Rankine cycle apparatus shown in FIG. 19, the amount of water supply to the evaporator 111 varies because the engine output varies as illustrated in (B) of FIG. 18 in response to the start/stop of the vehicle and transitional vehicle velocity variation as illustrated in (A) of FIG. 18, so that the liquid level position 112 in the cooling pipes 103 of the condenser 100 would vary. Namely, in the condenser 100, the liquid level position 112 rises when the inflow amount of vapor is greater than the discharge amount of condensed water, but falls when the inflow amount of vapor is smaller than the discharge amount of condensed water.

By contrast, according to the instant embodiment, the above-described liquid level position control is performed when the vehicle varies in traveling velocity as illustrated in (A) of FIG. 18, and thus, the liquid level position can be controlled to vary between the upper-limit and lower-limit positions $H_A$ and $H_B$ at the time of a start/stop of traveling of the vehicle. As a consequence, the instant embodiment can reliably prevent great variation or fluctuation in the liquid level position within the condenser 13 as illustrated in (E) of FIG. 18.

In the present invention, as set forth above, the positional variation in the liquid level 65 of the water (condensed water) W1 accumulated in the condenser 13 is confined to the predetermined range, so that respective variation of the heat transmission areas of the gaseous-phase portion and liquid-phase portion, corresponding to vapor and condensed water, in the condenser 13 can be effectively reduced. As a consequence, the present invention can perform the necessary cooling without regard to variation in the heat transmission areas and achieve an enhanced accuracy of the control. Also, the present invention can reduce cavitations in the pump device and extra heat energy consumption during re-heating in the evaporator 11.

Further, the present invention can keep a variation width of the heat transmission areas within a permissible range and impart a hysteresis to switching between discharge and replenishment of the liquid-phase working medium, to thereby lower the frequency of the switching operation. As a result, the present invention can achieve stabilized operation of the condenser 13 and enhanced durability of devices involved in the discharge and replenishment of the liquid-phase working medium.

Moreover, because the present invention can appropriately control the liquid level by discharging the liquid-phase working medium (water) from within the condenser 13 while preventing discharge of the gaseous-phase working medium (vapor), it can achieve even further stabilized operation of the condenser 13.

Furthermore, the present invention can replenish the liquid-phase working medium directly up to the set liquid level from the reserving open tank, accumulating the liquid-phase working medium, via the return pump, so that the liquid level position can be appropriately adjusted and accurately stabilized promptly through high-response and high-precision supply amount control of the pump.

In addition, the present invention can perform the liquid level position control while keeping the necessary total mass flow rate of the working medium in the circulation circuitry, and thus, the circulation circuitry need not be equipped with particular devices indented for working medium discharge and replenishment to and from the outside.

Furthermore, the present invention can reduce differences in the liquid level position among the cooling pipes of the condenser and thereby accurately stabilize the liquid level promptly during the discharge and replenishment of the liquid-phase working medium, as a result of which the present invention can achieve even further stabilized operation of the condenser 13.

Obviously, various minor changes and modifications of the present invention are possible in the light of the above teaching. It is therefore to be understood that within the scope of the appended claims the invention may be practiced otherwise than as specifically described.

What is claimed is:

1. A Rankine cycle apparatus constructed into a closed circulation circuit, which comprises:

an evaporator for heating and thereby converting a liquid-phase working medium into a gaseous-phase working medium, using heat from a heat source;

an expander for converting heat energy of the gaseous-phase working medium, discharged by said evaporator, into mechanical energy;

a condenser for cooling and thereby converting the gaseous-phase working medium, discharged by said expander, to the liquid phase;

a supply pump for supplying, in a pressurized condition, the liquid-phase working medium, discharged by said condenser, to said evaporator; and a discharge valve device provided between said supply pump and said evaporator in a portion of said closed circulation circuit where the working medium is in a liquid-phase state, wherein said discharge valve device discharges the working medium out of said closed circulation circuit when an interior pressure of said closed circulation circuit is higher than a predetermined limit pressure level that is lower than at least an allowable maximum pressure level of said expander or said evaporator.

2. The Rankine cycle apparatus as claimed in claim 1, wherein at least a portion of the working medium to be discharged out of said closed circulation circuit via said discharge valve device is discharged around the heat source.

3. The Rankine cycle apparatus as claimed in claim 1, wherein said discharge valve device includes a plurality of discharge passageways for directing the working medium out of said closed circulation circuit, and a flow rate limiter is provided in at least one of said plurality of discharge passageways.

4. The Rankine cycle apparatus as claimed in claim 1, wherein said discharge valve device is disposed at least closer to said pump unit than said evaporator.

5. The Rankine cycle apparatus as claimed in claim 1, wherein said heat source comprises an exhaust pipe, and said discharge valve device discharges the working medium out of said closed circulation circuit and into at least one of an inlet portion and an outlet portion of the exhaust pipe with respect to the evaporator when the interior pressure of said closed circulation circuit is higher than the predetermined limit pressure level that is lower than at least the allowable maximum pressure level of said expander or said evaporator.

6. The Rankine cycle apparatus as claimed in claim 5, wherein the discharge valve device discharges the working medium into the inlet portion of the exhaust pipe to cool the exhaust pipe and the evaporator.

7. The Rankine cycle apparatus as claimed in claim 6, wherein the discharge valve device includes a first discharge passage for directing the working medium into the inlet portion of the exhaust pipe.

8. The Rankine cycle apparatus as claimed in claim 7, wherein the first discharge passage comprises a flow rate limiter to control a flow rate of the working medium into the inlet portion of the exhaust pipe.

9. The Rankine cycle apparatus as claimed in claim 7, wherein the discharge valve device includes a second discharge passage for directing the working medium into the outlet portion of the exhaust pipe.

10. The Rankine cycle apparatus as claimed in claim 9, wherein the second discharge passage comprises a piping that is free of a flow rate limiter.

11. The Rankine cycle apparatus as claimed in claim 5, wherein the Rankine cycle apparatus is mounted on an automotive vehicle, and said heat source comprises an exhaust gas from the vehicle.

12. The Rankine cycle apparatus as claimed in claim 5, wherein the discharge valve device is controlled to discharge the working medium in a liquid-phase state to reduce an interior pressure in the closed circulation circuit.

13. The Rankine cycle apparatus as claimed in claim 12, wherein the discharge valve device then discharges vapor having flown backward from the evaporator.

* * * * *